US008684502B2

(12) United States Patent
Ohgaki

(10) Patent No.: US 8,684,502 B2
(45) Date of Patent: Apr. 1, 2014

(54) LIQUID-DISCHARGING HEAD FOR PRODUCING TONER

(75) Inventor: Masaru Ohgaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 395 days.

(21) Appl. No.: 12/831,575

(22) Filed: Jul. 7, 2010

(65) Prior Publication Data

US 2011/0007116 A1 Jan. 13, 2011

(30) Foreign Application Priority Data

Jul. 13, 2009 (JP) ..... 2009-164520

(51) Int. Cl.
*B41J 2/045* (2006.01)

(52) U.S. Cl.
USPC ..... 347/70; 347/68; 430/137.22

(58) Field of Classification Search
USPC ..... 347/70, 68, 47; 430/137.22
See application file for complete search history.

(56) References Cited

U.S. PATENT DOCUMENTS

| | | | | |
|---|---|---|---|---|
| 5,381,166 | A * | 1/1995 | Lam et al. | 346/140.1 |
| 2004/0048183 | A1* | 3/2004 | Teshima | 430/137.1 |
| 2005/0035999 | A1* | 2/2005 | Kitahara et al. | 347/47 |
| 2007/0257968 | A1* | 11/2007 | Hashimoto et al. | 347/72 |
| 2008/0030548 | A1 | 2/2008 | Kubo | |
| 2008/0063971 | A1 | 3/2008 | Watanabe et al. | |
| 2008/0227011 | A1 | 9/2008 | Kuramoto et al. | |
| 2008/0241727 | A1 | 10/2008 | Norikane et al. | |
| 2008/0248416 | A1 | 10/2008 | Norikane et al. | |
| 2008/0286679 | A1 | 11/2008 | Norikane et al. | |
| 2008/0286680 | A1 | 11/2008 | Norikane et al. | |
| 2008/0292985 | A1 | 11/2008 | Suzuki et al. | |
| 2009/0085985 | A1 | 4/2009 | Matsuzawa | |
| 2009/0117486 | A1 | 5/2009 | Watanabe et al. | |
| 2009/0170018 | A1* | 7/2009 | Kuramoto et al. | 430/108.22 |
| 2009/0226837 | A1 | 9/2009 | Norikane et al. | |
| 2009/0239170 | A1 | 9/2009 | Honda et al. | |
| 2009/0317738 | A1 | 12/2009 | Honda et al. | |
| 2009/0325100 | A1 | 12/2009 | Watanabe et al. | |
| 2010/0003613 | A1 | 1/2010 | Honda et al. | |
| 2010/0021209 | A1 | 1/2010 | Watanabe et al. | |
| 2010/0055600 | A1 | 3/2010 | Norikane et al. | |

FOREIGN PATENT DOCUMENTS

| | | |
|---|---|---|
| EP | 2 138 901 A1 | 12/2009 |
| JP | 9-323409 | 12/1997 |
| JP | 2007-199463 | 8/2007 |
| WO | WO 2008/114655 A1 | 9/2008 |

OTHER PUBLICATIONS

European Communication pursuant to Article 94(3) EPC issued Apr. 25, 2013, in Application No. 10 169 237.4-1701.

* cited by examiner

*Primary Examiner* — Henok Legesse
(74) *Attorney, Agent, or Firm* — Oblon, Spivak, McClelland, Maier & Neustadt, L.L.P.

(57) ABSTRACT

A liquid-discharging head including a reservoir for a spray liquid, a nozzle plate having a plurality of nozzles from which the spray liquid reserved in the reservoir can be discharged, and a vibration generating unit having a vibrating surface facing the nozzle plate, wherein the reservoir is divided into a plurality of liquid chambers, wherein the vibration generating unit has elongated convex portions in a plurality of rows, the elongated convex portions being made of a piezoelectric element, wherein each of the liquid chambers is provided so as to correspond to one of the elongated convex portions, and wherein the liquid-discharging head is used in a method for producing particles, and the method comprises periodically discharging liquid droplets of the spray liquid from the nozzles and solidifying the liquid droplets so as to form particles.

17 Claims, 7 Drawing Sheets

LIQUID-DISCHARGING HEAD FOR PRODUCING TONER

BACKGROUND OF THE INVENTION

1. Field of the Invention

The present invention relates to a liquid-discharging head used for producing a toner, a toner production method, a toner production apparatus and a toner. Specifically, the present invention relates to a toner production method based on a jetting granulating method, a toner production apparatus based on a jetting granulating method, and a toner produced with a jetting granulating method.

2. Description of the Related Art

Developers used for developing electrostatic images in, for example, electrophotography, electrostatic recording and electrostatic printing adhere, at a developing step, to an image bearing member (e.g., a latent electrostatic image bearing member) on which a latent electrostatic image has been formed. The developers are transferred from the image bearing member onto a recording medium (e.g., a recording paper sheet) at a transfer step and then, are fixed on the surface of the recording medium at a fixing step. As has been known, such developers that develop a latent electrostatic image formed on the image bearing member are roughly classified into two-component developers containing a carrier and a toner and one-component developers requiring no carrier (i.e., magnetic or non-magnetic toners).

Conventionally, as a dry-process toner used in, for example, electrophotography, electrostatic recording and electrostatic printing, a so-called "pulverized toner" is widely used, which is produced by melt-kneading a toner binder (e.g., a styrene resin and a polyester resin) together with a colorant, followed by finely pulverizing.

Also, the recent interest has focused on so-called polymerization toners produced with toner production methods based on the suspension polymerization method and/or the emulsion polymerization aggregation method. In addition, Japanese Patent Application Laid-Open (JP-A) No. 07-152202 discloses a polymer dissolution suspension method. In this method, toner materials are dispersed and/or dissolved in a volatile solvent such as an organic solvent having a low boiling point. The resultant liquid is emulsified in an aqueous medium in the presence of a dispersing agent to form liquid droplets. The volatile solvent is removed from the liquid droplets while shrinking the volume thereof. Unlike the suspension polymerization method and the emulsion polymerization aggregation method, the polymer dissolution suspension method is advantageous in that a wider variety of resins, especially, a polyester resin can be used. The polyester resin is used for forming a full-color image having transparency and smoothness in image portions after fixing.

The polymerization toners must be prepared in an aqueous medium in the presence of a dispersing agent and thus, the dispersing agent remains on the surface of the formed toner particles and degrades chargeability and environmental stability thereof. In order to avoid such an unfavorable phenomenon, the remaining dispersing agent must be removed using a very large amount of wash water. Thus, the production method for the polymerization toner is not necessarily satisfactory.

Meanwhile, a spray drying method has been used for a long period of time as a toner production method using no aqueous medium (see Japanese Patent Application Publication (JP-B) No. 57-201248). This method includes discharging a toner material liquid (in which toner components have been melted or a toner composition liquid has been dissolved) in the form of fine particles using various atomizers, and drying the discharged liquid fine particles to form toner particles. Thus, this method does not involve failures occurring when an aqueous medium is used.

However, the obtained particles with such a conventional spray drying (spray granulating) method are relatively coarse particles and also have a broad particle size distribution, which degrades the characteristics of the formed toner.

As a toner production method replacing the above-described methods, Japanese Patent (JP-B) No. 3786034 discloses a method and apparatus in which a toner composition liquid is formed into microdroplets by piezoelectric pulsation, and the thus-formed microdroplets are solidified through drying to produce toner particles. Also, JP-B No. 3786035 discloses a method in which a toner composition liquid is formed into microdroplets by the action of thermal expansion in nozzles, and the thus-formed microdroplets are solidified through drying to produce toner particles.

In toner production methods and apparatuses disclosed in JP-B Nos. 3786034 and 3786035, liquid droplets are discharged from one nozzle using one piezoelectric element. Thus, these methods and apparatuses pose a problem in that the number of liquid droplets that can be ejected from one nozzle per unit of time is limited to make their productivity low.

Furthermore, in the above-described toner production methods and apparatuses disclosed in JP-B Nos. 3786034 and 3786035, unfavorable liquid leakage or air bubbles prevent liquid droplets from being discharged stably.

Furthermore, JP-A No. 2007-199463 discloses a toner production method and apparatus in which liquid columns are generated from nozzles by pressurizing the liquid chamber, the thus-generated liquid columns are further divided and formed into droplets by slightly applying ultrasonic vibration thereto, and the droplets are solidified through drying to produce toner particles.

In a toner production method and apparatus disclosed in JP-A No. 2007-199463, a toner composition liquid is constantly pressurized toward nozzles. Thus, ultrafine particles of a colorant (pigment), a releasing agent, etc. (i.e., essential components of the toner composition liquid) are often clogged in the nozzles, which is a typical problem of toner production methods.

BRIEF SUMMARY OF THE INVENTION

The present invention has been made to solve the above existing problems, and aims to provide a toner production method which has improved toner production efficiency and is able to stably produce toner particles having less variation than those produced with a conventional production method in terms of various characteristics required for toner such as flowability and charging characteristics.

In the spray granulating method, the size of a thin film having a plurality of nozzles is determined depending on the number of the nozzles. In order to increase the production efficiency of toner, it is preferred that a number of nozzles are provided in the thin film. For this purpose, the dimension of the thin film and liquid chamber must be considerably larger than in the conventional toner production apparatuses disclosed in JP-B Nos. 3786034 and 3786035. In addition, in order to efficiently cause a liquid resonance phenomenon in the liquid chamber, the constituent members of the liquid chamber, especially the thin film having the nozzles, must have high rigidity.

In view of this, the present inventors conducted extensive studies on the configuration in which uniform liquid droplets can be formed even when the number of nozzles per liquid chamber is increased, and have made the present invention.

In order to solve the above-described problems, the present invention provides a liquid-discharging head which includes a reservoir for a spray liquid, a nozzle plate having a plurality of nozzles from which the spray liquid reserved in the reservoir can be discharged, and a vibration generating unit having a vibrating surface facing the nozzle plate, wherein the reservoir is divided into a plurality of liquid chambers, wherein the vibration generating unit has elongated convex portions in a plurality of rows, the elongated convex portions being made of a piezoelectric element, wherein each of the liquid chambers is provided so as to correspond to one of the elongated convex portions, and wherein the liquid-discharging head is used in a method for producing particles, and the method includes periodically discharging liquid droplets of the spray liquid from the nozzles and solidifying the liquid droplets so as to form particles.

Specifically, the present invention is as follows.

<1> A liquid-discharging head including:

a reservoir for a spray liquid, a nozzle plate having a plurality of nozzles from which the spray liquid reserved in the reservoir can be discharged, and a vibration generating unit having a vibrating surface facing the nozzle plate, wherein the reservoir is divided into a plurality of liquid chambers, wherein the vibration generating unit has elongated convex portions in a plurality of rows, the elongated convex portions being made of a piezoelectric element, wherein each of the liquid chambers is provided so as to correspond to one of the elongated convex portions, and wherein the liquid-discharging head is used in a method for producing particles, and the method comprises periodically discharging liquid droplets of the spray liquid from the nozzles and solidifying the liquid droplets so as to form particles.

<2> The liquid-discharging head according to <1> above, wherein the elongated convex portions are made by forming grooves in one plate-like piezoelectric element in a plurality of rows.

<3> The liquid-discharging head according to one of <1> and <2> above, wherein the spray liquid is a toner composition liquid prepared by dispersing or dissolving a toner composition containing at least a resin and a colorant.

<4> The liquid-discharging head according to any one of <1> to <3> above, wherein the number of nozzles facing one liquid chamber is 2 to 200.

<5> The liquid-discharging head according to any one of <1> to <4> above, wherein the nozzles are arranged at intervals of 60 μm to 200 μm.

<6> The liquid-discharging head according to any one of <1> to <5> above, wherein fine concave and convex portions with a peak-to-valley height of 0.2 μm or smaller are formed in a surface of the nozzle plate at high density.

<7> The liquid-discharging head according to any one of <1> to <6> above, wherein a surface of the nozzle plate is coated with a fluorine-containing coating material.

<8> The liquid-discharging head according to any one of <1> to <7> above, wherein nozzles with different diameters are disposed in a part of the nozzle plate, the part corresponding to one liquid chamber.

<9> The liquid-discharging head according to any one of <1> to <8> above, wherein the product of liquid pressure put on each nozzle and area of an opening of the nozzle is constant.

<10> The liquid-discharging head according to any one of <1> to <9> above, wherein the nozzle plate has at least one nozzle from which the spray liquid is not discharged.

<11> The liquid-discharging head according to any one of <1> to <10> above, wherein the area of an opening of the nozzle from which the spray liquid is not discharged is twice or more greater than the area of an opening of the nozzle from which the spray liquid is discharged.

<12> A toner produced with a liquid-discharging head which includes a reservoir for a spray liquid which is a toner composition liquid prepared by dispersing or dissolving a toner composition containing at least a resin and a colorant, a nozzle plate having a plurality of nozzles from which the spray liquid reserved in the reservoir can be discharged, and a vibration generating unit having a vibrating surface facing the nozzle plate, wherein the reservoir is divided into a plurality of liquid chambers, wherein the vibration generating unit has elongated convex portions in a plurality of rows, wherein each of the liquid chambers is provided so as to correspond to one of the elongated convex portions, and wherein the liquid-discharging head is used in a method for producing particles, and the method includes periodically discharging liquid droplets of the spray liquid from the nozzles and solidifying the liquid droplets so as to form particles.

<13> A method for producing particles, including:

periodically discharging liquid droplets of a spray liquid from a plurality of nozzles with a liquid-discharging head, and solidifying the liquid droplets so as to form particles, wherein the liquid-discharging head includes a reservoir for the spray liquid, a nozzle plate having the nozzles from which the spray liquid reserved in the reservoir can be discharged, and a vibration generating unit having a vibrating surface facing the nozzle plate, wherein the reservoir is divided into a plurality of liquid chambers, wherein the vibration generating unit has elongated convex portions in a plurality of rows, the elongated convex portions being made of a piezoelectric element, and wherein each of the liquid chambers is provided so as to correspond to one of the elongated convex portions.

<14> The method for producing particles according to <13> above, wherein the elongated convex portions are made by forming grooves in one plate-like piezoelectric element in a plurality of rows.

<15> The method for producing particles according to one of <13> and <14> above, wherein the spray liquid is a toner composition liquid prepared by dispersing or dissolving a toner composition containing at least a resin and a colorant.

<16> The method for producing particles according to any one of <13> to <15> above, wherein the vibration frequency of the vibration generating unit is 10 kHz or higher but lower than 2.0 MHz.

<17> An apparatus for producing a toner, including:

a liquid-discharging head which includes a reservoir for a spray liquid which is a toner composition liquid prepared by dispersing or dissolving a toner composition containing at least a resin and a colorant, a nozzle plate having a plurality of nozzles from which the spray liquid reserved in the reservoir can be discharged, and a vibration generating unit having a vibrating surface facing the nozzle plate, a periodically discharging unit configured to periodically discharge liquid droplets of the spray liquid from the nozzles, and a particle forming unit configured to solidify the liquid droplets so as to form particles, wherein the reservoir is divided into a plurality of liquid chambers, wherein the vibration generating unit has elongated convex portions in a plurality of rows, and wherein each of the liquid chambers is provided so as to correspond to one of the elongated convex portions.

In the above-described configuration, the vibration frequency of the vibration generating unit is preferably 10 kHz or higher but lower than 2.0 MHz in the periodically discharging liquid droplets, in order for fine particles (e.g., pigment fine particles) dispersed in the toner composition liquid not to deposit on the nozzles. The diameter of an opening of each nozzle is preferably 4 μm to 20 μm from the viewpoint of producing toner particles having small particle diameters. By adjusting the number of nozzles facing one liquid chamber to 2 to 200, satisfactory productivity can be ensured with a compact configuration.

Also, as described in <1> above, one liquid chamber of the reservoir is a relatively small space, and the nozzles are open to this space. With this configuration, the pressure wave can be easily controlled in the liquid chamber, improving productivity.

In the nozzle plate as described in <6> above, fine concave and convex portions with a peak-to-valley height of 0.2 μm or smaller are formed in a surface of the nozzle plate at high density (for example, these fine concave and convex portions are densely arranged at intervals of 0.3 μm). Thus, the contact angle with respect to the solution can be maintained high to suppress exuding of the solution, realizing stable discharging.

In the nozzle plate as described in <7> above, a surface of the nozzle plate is coated with a fluorine-containing coating material. Thus, the contact angle with respect to the solution can be maintained high to suppress exuding of the solution, realizing stable discharging.

In the nozzle plate as described in <8> above, the diameters of the nozzles are varied with the positions thereof. Thus, the amount of the liquid droplets discharged can be controlled, and the particle size distribution of the formed toner can be designed.

In the nozzle plate as described in <9> above, the diameter of each nozzle is set so that the product of liquid pressure put on the nozzle and area of an opening of the nozzle becomes constant. Thus, the amount of the liquid droplets discharged becomes uniform in the nozzles, producing a toner having a sharper particle size distribution.

The nozzle plate as described in <10> above has the nozzle from which the spray liquid is not discharged, and thus, is excellent in liquid-filling property. In addition, air can be easily eliminated, leading to easy maintenance.

In the nozzle plate as described in <11> above, the area of an opening of the nozzle from which the spray liquid is not discharged is twice or more greater than the area of an opening of the nozzle from which the spray liquid is discharged. Thus, liquid filling and air elimination can be easily performed. In addition, abnormal discharging (e.g., discharging due to cross talk during liquid discharge) can be completely prevented.

The toner produced with the above-described liquid-discharging head has very narrow particle size distribution, and thus, can produce high-quality images. In addition, the dissolved matter is controlled in a wide range and the production process is simple. Therefore, particle design can be conducted responding to the image engine used, considerably reducing the production cost. Further, using the nozzle plate as described in <8> above to control the particle size distribution, particles having more functions can also be produced.

According to the present invention, by using the liquid-discharging head in which a plurality of nozzles are disposed in each liquid chamber facing each elongated convex portion obtained by forming grooves in one plate-like piezoelectric element, liquid droplets can be formed in a stably controlled manner. With this configuration, a device in which nozzles are disposed at high density can be fabricated. Using this device, productivity can be remarkably improved as compared with the conventional cases.

The toner according to the present invention is produced with the method employing the liquid-discharging head according to the present invention. The toner particles have less variation than those produced with a conventional production method in terms of various characteristics required for toner such as flowability and charging characteristics.

Also, the system using the liquid-discharging head has short steps and is simple, and thus, use of the liquid-discharging head allows a plant to be downsized. As a result, the production cost can be reduced. Furthermore, the composition of a liquid used can be easily changed, and various kinds of products can be produced.

The toner particles having a particle size distribution responding to individual image engines can be produced, making most of the ability of the image engine.

DETAILED DESCRIPTION OF THE INVENTION

Figure 1:
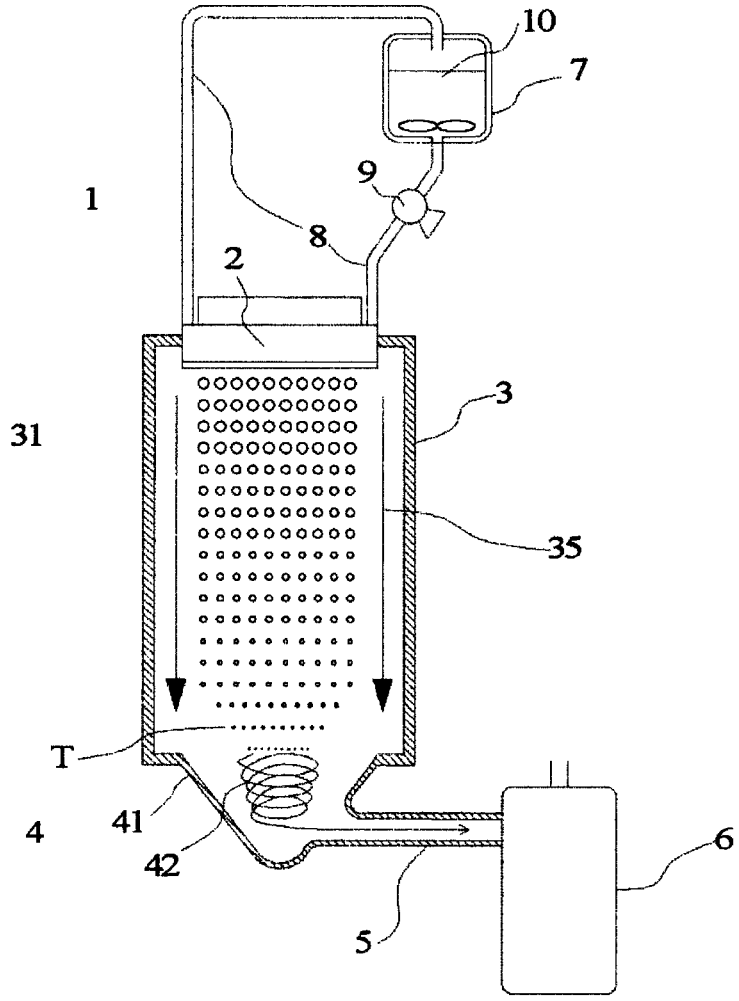
FIG. 1 schematically illustrates an exemplary toner production apparatus of the present invention.

Hereinafter, the present invention will be described with reference to the accompanying drawings. First, one exemplary toner production apparatus containing a liquid-discharging head (for producing a toner) of the present invention will be described with reference to the schematic configuration of FIG. 1.

A toner production apparatus 1 includes a liquid droplet jetting unit 2, a particle forming section 3, a toner collecting section 4, a tube 5, a toner reservoir 6, a material accommodating unit 7, a liquid feeding pipe 8, and a pump 9. In this apparatus, the liquid droplet jetting unit 2 has a liquid-discharging head and serves as a liquid droplet forming unit configured to discharge, in the form of liquid droplet, a toner composition containing at least a resin and a colorant. The particle forming section 3 is disposed below the liquid droplet jetting unit 2 and serves as a particle forming unit configured to form toner particles T by solidifying liquid droplets of the toner composition liquid which are discharged from the liquid droplet jetting unit 2. The toner collecting section 4 collects the toner particles T formed in the particle forming section 3. The toner reservoir 6 serves as a toner reserving unit configured to reserve the toner particles T transferred through the tube 5 from the toner collecting section 4. The material accommodating unit 7 accommodates a toner composition liquid 10. The liquid feeding pipe 8 feeds the toner composition liquid 10 from the material accommodating unit 7 to the liquid droplet jetting unit 2. The pump 9 pressure-feeds the toner composition liquid 10 upon operation of the toner production apparatus.

During operation of the toner production apparatus, the toner composition liquid 10 sent from the material accommodating unit 7 can be self-supplied to the liquid droplet jetting unit 2 by virtue of the liquid droplet forming phenomenon (which is brought by the liquid droplet jetting unit 2), and thus, the pump 9 is subsidiarily used for liquid supply. Notably, the toner composition liquid 10 is a solution/dispersion prepared by dissolving/dispersing, in a solvent, a toner composition containing at least a resin and a colorant. Most preferably, the circulating system as illustrated in FIG. 1 is established.

<Liquid Droplet Jetting Unit>

(1) Head

Figure 2:
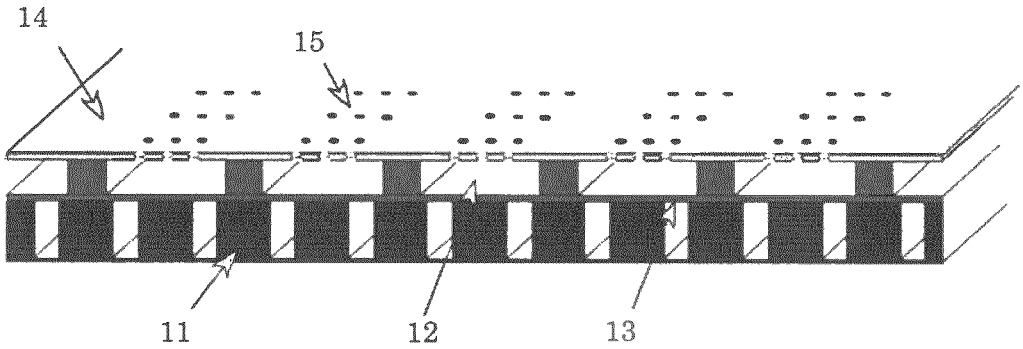
FIG. 2 is a cross-sectional, perspective view of a partial structure of an exemplary head used in a toner production apparatus of the present invention.

Next, the configuration of a liquid-discharging head will be described with reference to FIG. 2.

An illustrated liquid-discharging head includes a nozzle plate 14, a reservoir divided into liquid chambers 12, a vibration generating unit 11 and a vibrating plate 13. The vibration generating unit 11 has elongated convex portions formed by dicing one plate-like piezoelectric element, and transmits signals to the liquid chambers via the elongated convex portions and the vibrating plate 13. The nozzle plate 14 has a plurality of nozzles (ejection holes) 15 and is provided above the liquid chambers 12. Each liquid chamber (liquid flow path) is defined by the nozzle plate 14, the vibration generating unit 11 and flow path members. The liquid chambers supply the toner composition liquid 10 containing at least a resin and a colorant to between the nozzle plate 14 and the vibration generating unit 11.

When grooves are formed in one plate-like piezoelectric element in a plurality of rows so as to form elongated convex portions in a plurality of rows, the piezoelectric element can respond to higher frequency. Also, as illustrated in FIG. 2, each elongated convex portion is preferably disposed at the center portion of each divided liquid chamber in the reservoir (i.e., at the center portion between the partitions). Further, by fixing the elongated convex portions of the piezoelectric element on the vibrating plate (so as to correspond to the nozzles), structural resonance can be suppressed. The number of partitions (i.e., the number of liquid chambers) depends on the intended usage frequency. For example, the intervals of the partitions (the distance between the centers thereof) may be 500 μm or smaller, and the thicknesses of the partitions may be 30 μm or greater. The vibrating plate may be a metal thin plate such as a nickel thin plate having a thickness of about 0.003 mm to about 0.05 mm. Also, in place of the vibrating plate, a coating material may be applied directly onto the vibration generating unit (PZT). In this case, an elastic material (e.g., silicone) is embedded into grooves.

(2) Nozzle Plate

The nozzle plate is fabricated through, for example, nickel electrocrylstallization, punching of SUS, laser processing of SUS, dry etching of Si, or precise molding or laser processing of SUS or a polymer material (e.g., a polyimide). The nozzles may have any shape appropriately selected. For example, preferably, the nozzle plate has a thickness of 10 μm to 500 μm and nozzles whose openings have diameters of 4 μm to 20 μm. This is because such a nozzle plate generates fine liquid droplets having a uniform particle diameter when the toner composition liquid is discharged from the nozzles in the form of liquid droplet. Notably, the diameter of the opening of each nozzle 11 is the diameter itself when the opening is true circle, and is the minor axis length when the opening is ellipsoid.

Figure 3:
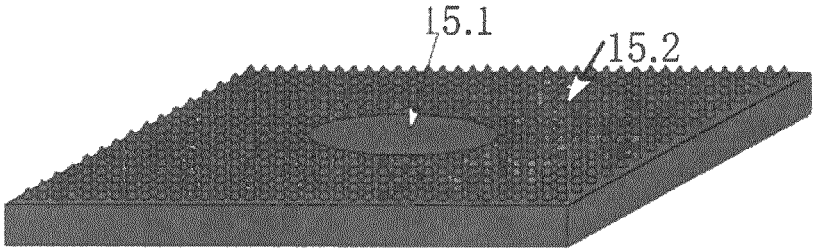
FIG. 3 illustrates an exemplary nozzle plate having fine concave and convex portions.
Figure 4:
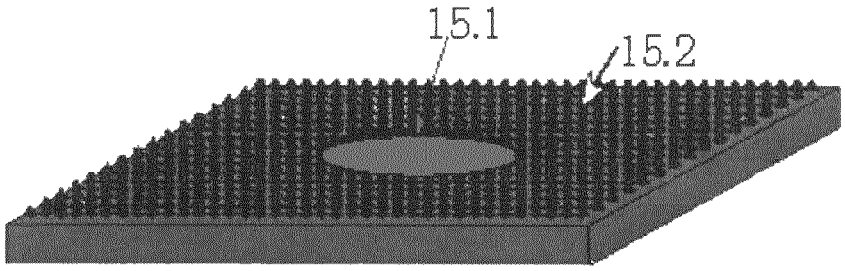
FIG. 4 illustrates an exemplary nozzle plate having fine concave and convex portions and coated with a fluorine-containing resin coat material.

In addition, from the viewpoint of improving liquid repellency, one surface of the nozzle plate (on the side opposite to the side where the toner composition liquid is supplied) is preferably provided with fine concave and convex portions (peak-to-valley height: 0.2 μm or smaller) at high density, especially in the vicinity of the nozzle (as illustrated in FIG. 3). Examples of the method for forming the fine concave and convex portions include dry etching and laser irradiation (laser interference or excimer laser abrasion). FIG. 4 illustrates a nozzle plate which is formed by depositing a fluorine-containing coating material on the nozzle plate of FIG. 3. In FIGS. 3 and 4, reference numerals 15.1 and 15.2 denote respectively the nozzle and the fine concave and convex portions. The fluorine-containing coating material may be deposited thereon with, for example, a dip method or a vapor evaporation method. Deposition of the fluorine-containing coating material can further increase the liquid repellency of the nozzle plate. Examples of the fluorine-containing coating material employable include OPTOOL and PTFE. When OPTOOL is used, the coating thickness is preferably 100 angstroms to 5,000 angstroms. When PTFE is used, the coating thickness is preferably 1,000 angstroms to 10,000 angstroms.

Notably, the peak-to-valley height is measured through peak to peak evaluation using an STM, and the fine concave and convex portions are densely arranged.

Figure 5A:
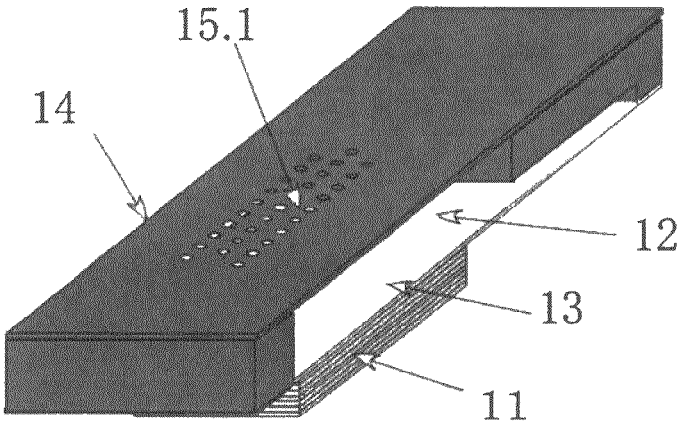
FIG. 5A illustrates a partial structure of one exemplary head in a toner production apparatus of the present invention.
Figure 5B:
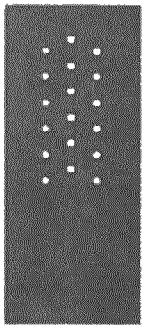
FIG. 5B illustrates a partial structure of one exemplary nozzle plate in a toner production apparatus of the present invention.

According to the present invention, as illustrated in FIG. 5A, the nozzle plate 14 having a plurality of nozzles 15.1 (FIG. 5B) is bonded to one liquid chamber 12, remarkably improving productivity. Notably, in FIG. 5A, reference numerals 11 and 13 denote respectively a vibration generating unit and a vibrating plate.

Figure 6A:
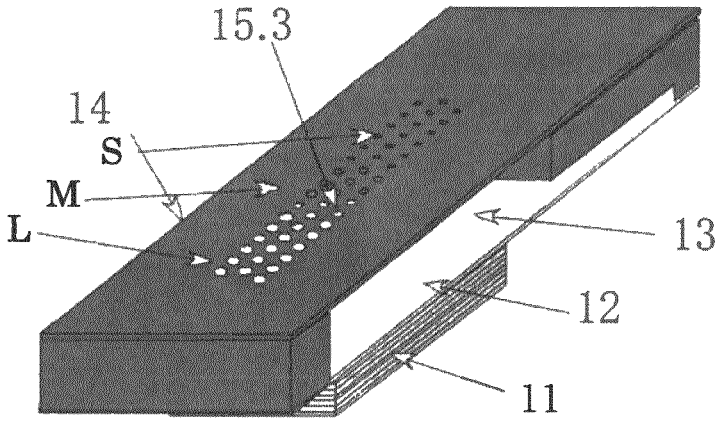
FIG. 6A illustrates a partial structure of another head in a toner production apparatus of the present invention.
Figure 6B:
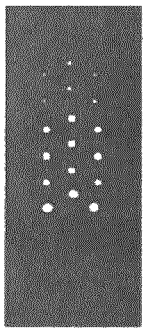
FIG. 6B illustrates a partial structure of another nozzle plate in a toner production apparatus of the present invention.

Also, the nozzle plate 14 illustrated in FIGS. 6A and 6B has nozzles 15.3 with different opening diameters. For example, by arranging the nozzles so that the product of liquid pressure (P) put on each nozzle and area (S) of an opening of the nozzle becomes constant considering the pressure distribution in the liquid chamber, the mass of each liquid droplet can be maintained constant. In FIG. 6A, the liquid flows from the back to the front, and the pressure of the liquid chamber tends to decrease toward the front of this figure. Therefore, in this nozzle plate, the nozzle opening is adjusted to increase from the back to the front, so that the product of pressure and area becomes constant. In FIG. 6A, reference numerals 11, 12 and 13 denote respectively a vibration generating unit, a vibrating plate and a liquid chamber, and symbols S, M and L denote small nozzles, middle nozzles and large nozzles.

Here, by intentionally arranging nozzles having different products of area S and pressure P, toners having several adjusted particle size distributions may be formed.

Figure 7A:
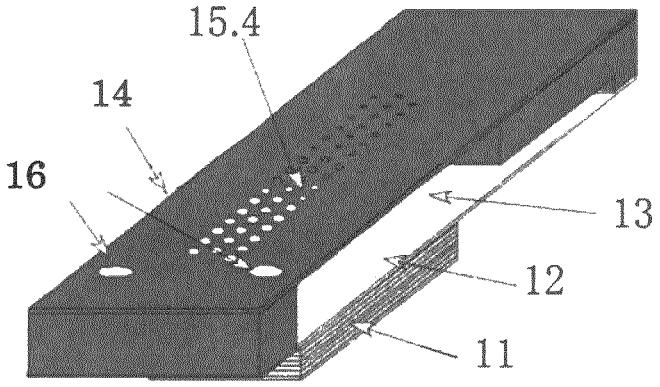
FIG. 7A illustrates a partial structure of still another head in a toner production apparatus of the present invention.
Figure 7B:
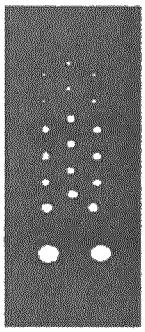
FIG. 7B illustrates a partial structure of still another nozzle plate in a toner production apparatus of the present invention.

The nozzle plate 14 illustrated in FIGS. 7A and 7B has, at the deepest portion in the liquid chamber, relatively large holes 16 from which liquid is not discharged. With this configuration, the liquid chamber can be easily filled with liquid without remaining air bubbles. In addition, an unfavorable phenomenon due to air bubbles generated during discharging can be easily prevented. In FIG. 7A, reference numerals 15.4, 11, 12 and 13 denote respectively nozzles, a vibration generating unit, a vibrating plate and a liquid chamber.

(3) Flow Path and Liquid Chamber

The flow paths and liquid chambers are formed with Si, SUS and a mold, and are bonded to the nozzle plate. When formed with, for example, Si, nickel electrocrylstallization or a mold, the flow paths and liquid chambers can be integrally formed with the nozzles. For example, FIGS. 8A to 8D are cross-sectional schematic views of a process in which the flow paths are integrally formed with Si nozzles using an SOI substrate. The flow paths and liquid chambers formed in this manner are used in Example 1.

Figure 8A:
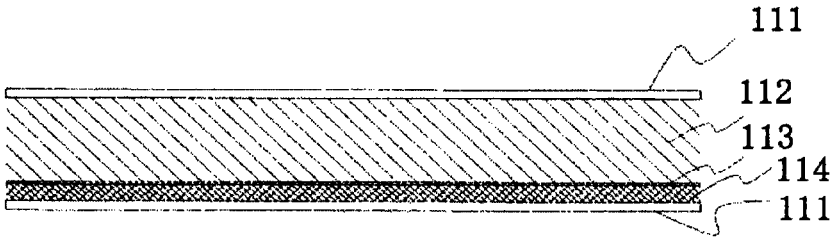
FIG. 8A is a first step of integrally forming flow paths and Si nozzles using an SOI substrate.
Figure 8B:
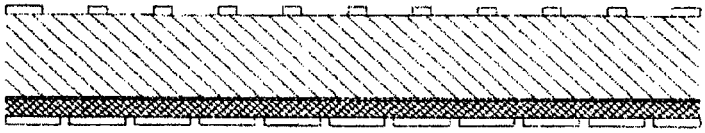
FIG. 8B is a second step of integrally forming flow paths and Si nozzles using an SOI substrate.
Figure 8C:
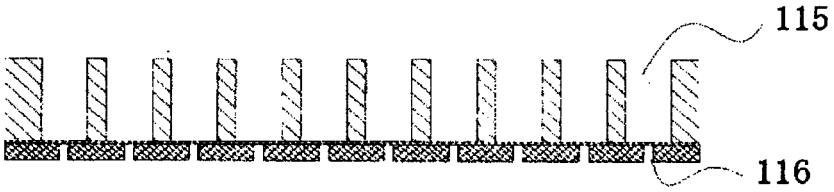
FIG. 8C is a third step of integrally forming flow paths and Si nozzles using an SOI substrate.
Figure 8D:
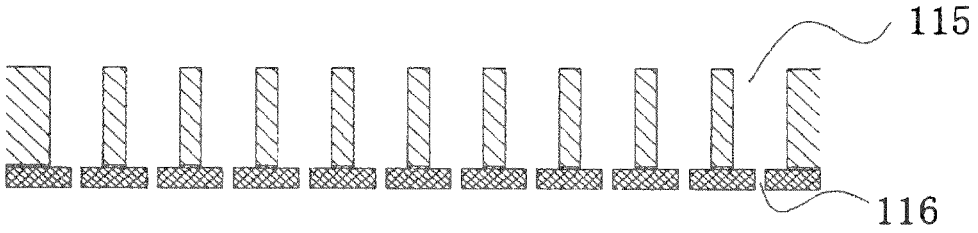
FIG. 8D is a fourth step of integrally forming flow paths and Si nozzles using an SOI substrate.

Next, the process will be described referring sequentially to FIGS. 8A to 8D. Most preferably, a silicon substrate, especially an SOI (Silicon on Insulator) substrate, is used. Both surfaces of the substrate are coated with a resist 111 (FIG. 8A), and are covered with photomasks each having a nozzle pattern, followed by irradiating with UV rays, to thereby form a nozzle-patterned resist 111 (FIG. 8B). Anisotropic dry etching is performed using ICP discharge from the side of a support layer 112 to form first nozzle holes 115, and similarly, anisotropic dry etching is performed from the side of an active layer 114 to form second nozzles 116 (FIG. 8C). Finally, a dielectric layer 113 is removed using a hydrofluoric acid-based etching liquid to form two-step through holes (FIG. 8D). The above-described manner is most preferred from the viewpoint of forming uniform deep nozzles.

(4) Vibrating Unit

The vibration generating unit 11 used is a piezoelectric element. In many cases, a laminated PZT or bulk PZT is used. But, the vibration generating unit is not particularly limited, so long as it can give a mechanical ultrasonic vibration to liquid at high amplitude. Examples thereof include a combination of a ultrasonic vibrator and a ultrasonic horn. The vibration generating unit has elongated convex portions arranged in a plurality of rows, which are formed by providing one plate-like piezoelectric element with grooves arranged in a plurality of rows. The size of the plate-like piezoelectric element may be determined in consideration of displacement intended to generate, limit voltage and cost. For example, a plate-like piezoelectric element of 4 mm×40 mm (t=0.5 mm) can be used to form grooves having a width of about 0.01 mm and a depth of 0.45 mm. The grooves can be formed with, for example, a dicing saw. In this case, when the interdistance of the grooves is 500 μm, the interdistance of the elongated convex portions is about 490 μm.

(5) Vibration Generating Unit

Examples of the piezoelectric element forming the vibration generating unit 11 include piezoelectric ceramics such as lead zirconium titanate (PZT). The piezoelectric ceramics generally exhibit a small displacement and thus, are often used in the form of laminate. Further examples include piezoelectric polymers such as polyvinylidene fluoride (PVDF), quartz crystal, and single crystals (e.g., $LiNbO_3$, $LiTaO_3$ and $KNbO_3$).

(6) Liquid Chamber

The partition walls of the liquid chambers are made of a material which is not dissolvable to a spray liquid and does not modify the spray liquid. The material may be selected from commonly used materials such as metals, ceramics and plastics.

(7) Flow Path Member

Each flow path member is connected at one or more portions to a liquid-feeding tube and an air bubble discharging tube (or a liquid circulating tube). The liquid-feeding tube is for feeding the toner composition liquid to the liquid chamber, and the air bubble discharging tube is for discharging air bubbles.

(8) Unit Configuration (Connection Between the Members)

The liquid-discharging head is provided in the liquid droplet jetting unit 2 in FIG. 1. The number of liquid-discharging heads is preferably 50 to 1,000 from the viewpoint of controllability. In this case, the liquid droplet jetting units 2 are each designed so that the toner composition liquid 10 is supplied from the material accommodating unit (common liquid reservoir) 7 through the pipe 8 to each reservoir. The toner composition liquid 10 may be self-supplied in synchronization with the formation of liquid droplets or may be supplied using the pump 9 subsidiarily during operation of the toner production apparatus.

(9) Operation Mechanism

Next, description will be given to the liquid droplet-forming mechanism by the liquid droplet jetting unit 2 serving as the liquid droplet forming unit. A vibration generated in the vibrating surface by the vibrating unit is transmitted to a liquid contained in the reservoir to cause liquid resonance. The liquid is isotropically pressurized and discharged to a gaseous phase from the nozzles of the thin film. By virtue of this liquid resonance, the liquid is uniformly discharged from all the nozzles. Furthermore, a large amount of fine particles dispersed in the toner composition liquid are maintained to be suspended (i.e., are not deposited on the thin film surface facing the reservoir) and thus, the toner composition liquid can stably jetted for a long period of time.

(10) Particle Forming Section

Referring again to FIG. 1, description will be given to the particle forming section 3 where toner particles T are formed by solidifying liquid droplets 31 of the toner composition liquid 10. Here, the toner composition liquid 10 is a solution or dispersion liquid prepared by dissolving or dispersing, in a solvent, a toner composition containing at least a resin and a colorant. Thus, in this section, the liquid droplets 31 are solidified through drying to form toner particles T.

That is, in this embodiment, the particle forming section 3 serves also as a solvent removal section where the liquid droplets 31 are dried by removing the solvent to form toner particles T (hereinafter the particle forming section 3 may be referred to as "solvent removal section" or "drying section").

Specifically, in this particle forming section 3, the liquid droplets 31 which have been discharged from the nozzles of the liquid droplet jetting unit 2 are conveyed with dry gas 35 flowing in a direction in which the liquid droplets 31 flow, to thereby remove the solvent of the liquid droplets 31 to form toner particles T. Notably, the dry gas 35 refers to a gas whose dew-point temperature under atmospheric pressure is −10° C. or lower. The dry gas 35 is not particularly limited, so long as it can dry the liquid droplets 31. Examples thereof include air and nitrogen.

Next, description will be given to the toner collecting section 4 serving as a toner collecting unit configured to collect the toner particles T formed in the particle forming section 3. The toner collecting section 4 is continuously formed subsequent to the particle forming section 3 so as to receive the flowing particles, and has a tapered surface 41 in which the pore size gradually decreases from the inlet (the side closer to the liquid droplet jetting unit 2) toward the outlet. In this configuration, the toner particles T are collected in the toner collecting section 4 by the action of air flow (vortex flow) 42 flowing downstream of this section. The air flow 42 is generated by sucking inside the toner collecting section 4 with, for example, a suction pump. In this manner, using the centrifugal force of vortex flow (air flow 42), the toner particles T can be assuredly collected and then transferred to the toner reservoir 6 provided downstream.

The toner particles T, which have been collected in the toner collecting section 4, are transferred through the tube 5 to the toner reservoir 6 by the action of vortex flow (air flow 42). When the toner collecting section 4, tube 5 and toner reservoir 6 are made of a conductive material, these are preferably connected to the ground (earth). Notably, this production apparatus is preferably an explosion-proof apparatus. In addition, the formed toner particles T may be pressure-fed from the toner collecting section 4 to the toner reservoir 6 or may be sucked from the toner reservoir 6.

(11) Production Method

Next, description will be given to a toner production method of the present invention using the toner production apparatus 1 having the above-described configuration. As described above, in the state where the toner composition liquid 10 (which is prepared by dispersing or dissolving, in a solvent, a toner composition containing at least a resin and a colorant) is supplied to the reservoir of the liquid droplet jetting unit 2, drive signals having a required drive frequency are applied to the vibration generating unit 11 to generate vibration in the vibrating plate 13, resonating the toner composition liquid in the reservoir. The drive frequency applied is determined depending on the resonance frequency of the structure. Thus, the resonance frequency of the structure is measured in advance. And, the drive frequency is determined based on the obtained measurement and is applied so that liquid droplets are stably discharged.

The vibration generated in the vibrating surface of the vibrating plate 13 is transmitted to the toner composition liquid 10 in the liquid chamber 12, causing a periodic change in pressure. As a result, upon application of pressure, the toner composition liquid is periodically discharged in the form of liquid droplet (i.e., as liquid droplets 31) from a plurality of nozzles 15 into the particle forming section 3 serving as the solvent removal section (see FIG. 1).

The liquid droplets 31 discharged into the particle forming section 3 are conveyed with dry gas 35 flowing in a direction in which the liquid droplets 31 flow in the particle forming section 3. As a result, the solvent is removed therefrom to form toner particles T. The toner particles T formed in the particle forming section 3 are collected by the action of air flow 42 in the toner collecting section 4 provided downstream, and then conveyed through the tube 5 to the toner reservoir 6.

Notably, in this embodiment, the liquid droplets of the toner composition liquid 10 (which is a solution or dispersion liquid prepared by dissolving or dispersing, in a solvent, a toner composition containing at least a resin and a colorant) are solidified (shrunken) by evaporating the organic solvent thereof with dry gas in the solvent removal section (particle forming unit), to thereby form toner particles. The present invention should not be construed as being limited to this embodiment.

In one alternative process employable, a solid toner composition is melted/liquefied in a heated reservoir to form a toner composition liquid, which is then ejected/discharged as liquid droplets. The resultant liquid droplets are solidified through cooling to form toner particles. In another alternative process employable, a toner composition liquid containing a thermosetting compound is discharged as liquid droplets, which are then solidified through curing reaction under heating to form toner particles.

Meanwhile, a plurality of nozzles 15 are provided in the liquid droplet jetting unit 2, and thus, a large number of liquid droplets 31 of the toner composition liquid are continuously discharged from these nozzles, leading to a remarkable increase in production efficiency of toner. In addition, as described above, when the plurality of nozzles 15 are provided in one liquid chamber, a large number of liquid droplets 31 can be discharged simultaneously. Also, vibration of the toner composition liquid in the reservoir prevents dispersed fine particles contained therein from being deposited. As a result, toner particles can be stably and efficiently produced without clogging of the nozzles 15. The particle size distribution of the produced toner particles has such a monodispersibility that could not be attained in conventional toner particles.

Next, the toner composition (toner materials) usable in the present invention will be described.

The toner materials usable are the same as those used in conventional electrophotographic toners. Specifically, intended toner particles can be produced as follows. First, a toner binder (e.g., a styrene acrylic resin, a polyester resin, a polyol resin or an epoxy resin) is dissolved in an organic solvent. Next, a colorant is dispersed in the resultant solution, and then a releasing agent is dispersed or dissolved in the resultant dispersion liquid. Next, with the above-described toner production method, the thus-prepared mixture is formed into fine liquid droplets, followed by drying/solidifying. Alternatively, the above materials are melted/kneaded to form a kneaded product. Next, the kneaded product is dissolved or dispersed in a solvent. With the above-described toner production method, the resultant solution or dispersion liquid is formed into fine liquid droplets, followed by drying/solidifying, to thereby form intended toner particles.

<Toner Composition>

The toner composition contains at least a resin and a colorant; and, if necessary, contains other ingredients such as a carrier and wax.

—Resin—

Examples of the resin include binder resins.

The binder resin is not particularly limited and may be appropriately selected from commonly used resins. Examples thereof include vinyl polymers formed of, for example, styrene monomers, acrylic monomers and/or methacrylic monomers; homopolymers or copolymers of these monomers; polyester polymers; polyol resins; phenol resins; silicone resins; polyurethane resins; polyamide resins; furan resin; epoxy resins; xylene resins; terpene resins; coumarone-indene resins; polycarbonate resins; and petroleum resins.

Examples of the styrene monomer include styrene and styrene derivatives such as o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene.

Examples of the acrylic monomer include acrylic acid and acrylates such as methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate and phenyl acrylate.

Examples of the methacrylic monomer include methacrylic acid and methacrylates such as methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate and diethylaminoethyl methacrylate.

Examples of other monomers forming the vinyl polymers or copolymers include those listed in (1) to (18) given below: (1) monoolefins such as ethylene, propylene, butylene and isobutylene; (2) polyenes such as butadiene and isoprene; (3) halogenated vinyls such as vinyl chloride, vinylidene chloride, vinyl bromide and vinyl fluoride; (4) vinyl esters such as vinyl acetate, vinyl propionate and vinyl benzoate; (5) vinyl ethers such as vinyl methyl ether, vinyl ethyl ether and vinyl isobutyl ether; (6) vinyl ketones such as vinyl methyl ketone, vinyl hexyl ketone and methyl isopropenyl ketone; (7) N-vinyl compounds such as N-vinylpyrrole, N-vinylcarbazole, N-vinylindole and N-vinylpyrrolidone; (8) vinylnaphthalenes; (9) acrylic or methacrylic acid derivatives such as acrylonitrile, methacrylonitrile and acrylamide; (10) unsaturated dibasic acids such as maleic acid, citraconic acid, itaconic acid, alkenylsuccinic acid, fumaric acid and mesaconic acid; (11) unsaturated dibasic acid anhydride such as maleic anhydride, citraconic anhydride, itaconic anhydride and alkenylsuccinic anhydride; (12) unsaturated dibasic acid monoesters such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate and monomethyl mesaconate; (13) unsaturated dibasic acid esters such as dimethyl maleate and dimethyl fumarate; (14) α,β-unsaturated carboxylic acids such as crotonic acid and cinnamic acid; (15) α,β-unsaturated carboxylic anhydride such as crotonic anhydride and cinnamic anhydride; (16) carboxyl group-containing monomers such as acid anhydrides formed between the above α,β-unsaturated carboxylic acids and lower fatty acids; and alkenylmalonic acid, alkenylglutaric acid, alkenyladipic acid, acid anhydrides thereof and monoesters thereof; (17) hydroxyalkyl (meth)acrylate such as 2-hydroxyethyl(meth) acrylate and 2-hydroxypropyl methacrylate; and (18) hydroxy group-containing monomers such as 4-(1-hydroxy-1-methylbutyl)styrene and 4-(1-hydroxy-1-methylhexyl)styrene.

In a toner of the present invention, the vinyl polymer or copolymer serving as a binder resin may have a crosslinked structure formed by a crosslinking agent containing two or more vinyl groups. Examples of the crosslinking agent which can be used for crosslinking reaction include aromatic divinyl compounds (e.g., divinyl benzene and divinyl naphthalene); di(meth)acrylate compounds having an alkyl chain as a linking moiety (e.g., ethylene glycol di(meth)acrylate, 1,3-butylene glycol di(meth)acrylate, 1,4-butanediol di(meth)acrylate, 1,5-pentanediol di(meth)acrylate, 1,6-hexanediol di(meth)acrylate and neopentyl glycol di(meth)acrylate); and di(meth)acrylate compounds having, as a linking moiety, an alkyl chain containing an ether bond (e.g., diethylene glycol di(meth)acrylate, triethylene glycol di(meth)acrylate, tetraethylene glycol di(meth)acrylate, polyethylene glycol #400 di(meth)acrylate, polyethylene glycol #600 di(meth)acrylate and dipropylene glycol di(meth)acrylate).

Further examples include di(meth)acrylate compounds having a linking moiety containing an aromatic group or ether bond; and polyester diacrylates (e.g., MANDA (trade name) (product of NIPPON KAYAKU CO., LTD.)).

Examples of multifunctional crosslinking agents which can be used in addition to the above crosslinking agent include pentaerythritol tri(meth)acrylate, trimethylolethane tri(meth)acrylate, trimethylolpropane tri(meth)acrylate, tetramethylolmethane tetra(meth)acrylate, oligoester (meth) acrylate, triallyl cyanurate and triallyl trimellitate.

The amount of the crosslinking agent used is preferably 0.01 parts by mass to 10 parts by mass, more preferably 0.03 parts by mass to 5 parts by mass, per 100 parts by mass of the monomer forming the vinyl polymer or copolymer. Among the above crosslinkable monomers, preferred are aromatic divinyl compounds (in particular, divinyl benzene) and diacrylate compounds having a linking moiety containing one aromatic group or ether bond, since these can impart desired fixing property and offset resistance to the formed toner. Also, copolymers formed between the above monomers are preferably styrene copolymers and styrene-acrylic copolymers.

Examples of polymerization initiators used for producing the vinyl polymer or copolymer in the present invention include 2,2'-azobisisobutylonitrile, 2,2'-azobis (4-methoxy-2,4-dimethylvaleronitrile), 2,2'-azobis (2,4-dimethylvaleronitrile), 2,2'-azobis(2-methylbutylonitrile), dimethyl-2,2'-azobisisobutyrate, 1,1'-azobis(1-cyclohexanecarbonitrile), 2-(carbamoylazo)-isobutylonitrile, 2,2'-azobis(2,4,4-trimethylpentane), 2-phenylazo-2',4'-dimethyl-4'-methoxyvaleronitrile, 2,2'-azobis (2-methylpropane), ketone peroxides (e.g., methyl ethyl ketone peroxide, acetylacetone peroxide and cyclohexanone peroxide), 2,2-bis (tert-butylperoxy)butane, tert-butyl hydroperoxide, cumene hydroperoxide, 1,1,3,3-tetramethylbutyl hydroperoxide, di-tert-butylperoxide, tert-butyl cumylperoxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl) peroxycarbonate, acetylcyclohexylsulfonyl peroxide, tert-butyl peroxyacetate, tert-butylperoxyisobutylate, tert-butylperoxy-2-ethylhexylate, tert-butylperoxylaurate, tert-butyl-oxybenzoate, tert-butylperoxyisopropylcarbonate, di-tert-butylperoxyisophthalate, tert-butylperoxyallylcarbonate, isoamylperoxy-2-ethylhexanoate, di-tert-butylperoxyhexahydroterephthalate and tert-butylperoxyazelate.

When the binder resin is a styrene-acrylic resin, tetrahydrofuran (THF) soluble matter of the resin preferably has such a molecular weight distribution as measured by GPC that at least one peak exists in a range of M.W. 3,000 to M.W. 50,000 (as reduced to a number average molecular weight) and at least one peak exists in a range of M.W. 100,000 or higher, since the formed toner has desired fixing property, offset resistance and storage stability. Preferably, THF soluble matter of the binder resin has a component with a molecular weight equal to or lower than M.W. 100,000 of 50% to 90%, more preferably has a main peak in a range of M.W. 5,000 to M.W. 30,000, most preferably M.W. 5,000 to M.W. 20,000.

The binder resin for toner and the composition containing the binder resin preferably have a glass transition temperature (Tg) of 35° C. to 80° C., more preferably 40° C. to 75° C., from the viewpoint of attaining desired storage stability of the formed toner. When the Tg is lower than 35° C., the formed toner tends to degrade under high temperature conditions and to involve offset during fixing. When the Tg is higher than 80° C., the formed toner may have degraded fixing property.

Examples of the magnetic material which can be used in the present invention include (1) magnetic iron oxides (e.g., magnetite, maghemite and ferrite), and iron oxides containing other metal oxides; (2) metals such as iron, cobalt and nickel, and alloys prepared between these metals and metals such as aluminum, cobalt, copper, lead, magnesium, tin, zinc, antimony, beryllium, bismuth, cadmium, calcium, manganese, selenium, titanium, tungsten and/or vanadium; and (3) mixtures thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These may be used alone or in combination. Of these, micropowders of ferrosoferric oxide or $\gamma$-iron sesquioxide are preferably exemplified.

Further, magnetic iron oxides (e.g., magnetite, maghemite and ferrite) containing other elements or mixtures thereof can be used. Examples of the other elements include lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. Of these, magnesium, aluminum, silicon, phosphorus and zirconium are preferred. The other element may be incorporated in the crystal lattice of an iron oxide, may be incorporated into an iron oxide in the form of oxide, or may be present on the surface of an iron oxide in the form of oxide or hydroxide. Preferably, it is contained in the form of oxide.

Incorporation of the other elements into the target particles can be performed as follows: salts of the other elements are allowed to coexist with the iron oxide during formation of a magnetic material, and then the pH of the reaction system is appropriately adjusted. Alternatively, after formation of magnetic particles, the pH of the reaction system may be adjusted with or without salts of the other elements, to thereby precipitate these elements on the surface of the particles.

The amount of the magnetic material used is preferably 10 parts by mass to 200 parts by mass, more preferably 20 parts by mass to 150 parts by mass, based on 100 parts by mass of the binder resins. The number average particle diameter of the magnetic material is preferably 0.1 μm to 2 μm, more preferably 0.1 μm to 0.5 μm. The number average particle diameter of the magnetic material can be measured by observing a magnified photograph thereof obtained through transmission electron microscopy using a digitizer or the like.

For magnetic properties of the magnetic material under application of 10 kOersted, it is preferably to use a magnetic material having an anti-magnetic force of 20 Oersted to 150 Oersted, a saturation magnetization of 50 emu/g to 200 emu/g, and a residual magnetization of 2 emu/g to 20 emu/g.

The magnetic material can also be used as a colorant.

[Colorant]

The colorant is not particularly limited and can be appropriately selected from commonly used colorants depending on the purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone, and mixtures thereof.

The colorant content is preferably 1% by mass to 15% by mass, preferably 3% by mass to 10% by mass, with respect to the toner.

In the present invention, the colorant may be mixed with a resin to form a masterbatch. Examples of the binder resin which is to be kneaded together with a masterbatch include modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

The amount of the masterbatch used is preferably 0.1 parts by mass to 20 parts by mass per 100 parts by mass of the binder resin.

The resin used for forming the masterbatch preferably has an acid value of 30 mgKOH/g or lower and amine value of 1 to 100, more preferably has an acid value of 20 mgKOH/g or lower and amine value of 10 to 50. In use, a colorant is preferably dispersed in the resin. When the acid value is higher than 30 mgKOH/g, chargeability degrades at high humidity and the pigment is insufficiently dispersed. Meanwhile, when the amine value is lower than 1 or higher than 100, the pigment may also be insufficiently dispersed. Notably, the acid value can be measured according to JIS K0070, and the amine value can be measured according to JIS K7237.

Also, a dispersing agent used preferably has higher compatibility with the binder resin from the viewpoint of attaining desired dispersibility of the pigment. Specific examples of commercially available products thereof include "AJISPER PB821," AJISPER PB822" (these products are of Ajinomoto Fin-Techno Co., Inc.), "Disperbyk-2001" (product of BYK-chemie Co.) and "EFKA-4010" (product of EFKA Co.).

The dispersing agent is preferably incorporated into the toner in an amount of 0.1% by mass to 10% by mass to that of the colorant. When the amount is less than 0.1% by mass, the dispersibility of the pigment may be insufficient. Whereas when the amount is more than 10% by mass, the formed toner may be degraded in chargeability under high-humidity conditions.

The dispersing agent preferably has a mass average molecular weight as measured through gel permeation chromatography of 500 to 100,000, more preferably 3,000 to 100,000, particularly preferably 5,000 to 50,000, most preferably 5,000 to 30,000, from the viewpoint of attaining desired dispersibility of the pigment, wherein the mass average molecular weight is a maximum molecular weight as converted to styrene on a main peak. When the mass average molecular weight is lower than 500, the dispersing agent has high polarity, potentially degrading dispersibility of the colorant. Whereas when the mass average molecular weight is higher than 100,000, the dispersing agent has high affinity to a solvent, potentially degrading dispersibility of the colorant.

The amount of the dispersing agent used is preferably 1 part by mass to 200 parts by mass, more preferably 5 parts by mass to 80 parts by mass, per 100 parts by mass of the colorant. When the amount is less than 1 part by mass, the dispersibility of the dispersing agent may be degraded. Whereas when the amount is more than 200 parts by mass, the chargeability of the formed toner may be degraded.

[Solvent]

The solvent is preferably organic solvents. The organic solvent is not particularly limited, and preferably has a boiling point lower than 150° C. from the viewpoint of allowing easy solvent removal. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. The organic solvent preferably has a solubility parameter of 8 $(cal/cm^3)^{1/2}$ to 9.8 $(cal/cm^3)^{1/2}$, more preferably 8.5 $(cal/cm^3)^{1/2}$ to 9.5 $(cal/cm^3)^{1/2}$, since such organic solvents can dissolve a larger amount of a polyester resin. Among the above organic solvents, ester solvents and ketone solvents are preferred, since these are highly reactive to a modified group of the releasing agent to effectively prevent crystal growth thereof. Particularly, ethyl acetate and methyl ethyl ketone are preferred from the viewpoint of allowing easy solvent removal.

[Other Components]

<Carrier>

The toner of the present invention may be used as a two-component developer together with a carrier. As to the carrier, typically used carrier such as ferrite and magnetite and resin-coated carrier can be used.

The resin-coated carrier is composed of carrier core particles and a resin (coating material) coated on the carrier core particles.

Examples of the resin preferably used as the coating material include styrene-acrylic resins such as styrene-acrylic ester copolymers, and styrene-methacrylic ester copolymers; acrylic resins such as acrylic ester copolymers, and methacrylic ester copolymers; fluorine-containing resins such as polytetrafluoroethylene, monochlorotrifluoroethylene polymers, and polyvinylidene fluoride; silicone resins, polyester resins, polyamide resins, polyvinyl butyral, and amino acrylate resins. Besides the above mentioned, resins that can be used as coating materials for carrier such as ionomer resins, and polyphenylene sulfide resins are exemplified. These resins may be used alone or in combination. In addition, it is possible to use a binder type carrier core in which magnetic powder is dispersed in a resin.

As a method of covering the surface of a carrier core with at least a resin coating material in the resin-coated carrier, the following methods can be used: a method in which a resin is dissolved or suspended to prepare a coating solution or suspension, and the coating solution/suspension is applied over a surface of the carrier core so as to adhere thereon; or a method of mixing a resin in a state of powder.

The mixing ratio of the coating material to the resin-coated carrier is not particularly limited and may be suitably selected in accordance with the intended use. For example, it is preferably 0.01% by mass to 5% by mass, and more preferably 0.1% by mass to 1% by mass with respect to the resin coated carrier.

For usage examples of coating a magnetic material with two or more types of coating material, the following are exemplified: (1) coating a magnetic material with 12 parts by mass of a mixture prepared using dimethyldichlorosilane and dimethyl silicone oil based on 100 parts by mass of titanium oxide fine powder at a mass ratio of 1:5; and (2) coating a magnetic material with 20 parts by mass of a mixture prepared using dimethyldichlorosilane and dimethyl silicone oil based on 100 parts by mass of silica fine powder at a mass ratio of 1:5.

Of these resins, a styrene-methyl methacrylate copolymer, a mixture of a fluorine-containing resin and a styrene-based copolymer, or a silicone resin is preferably used. In particular, a silicone resin is preferable.

Examples of the mixture of a fluorine-containing resin and a styrene-based copolymer include a mixture of polyvinylidene fluoride and a styrene-methyl methacrylate copolymer, a mixture of polytetrafluoroethylene and a styrene-methyl methacrylate copolymer, a mixture of vinylidene fluoride-tetrafluoroethylene copolymer (copolymerization mass ratio=10:90 to 90:10), a mixture of styrene-2-ethylhexyl acrylate copolymer (copolymerization mass ratio=10:90 to 90:10); a mixture of styrene-2-ethylhexyl acrylate-methyl methacrylate copolymer (copolymerization mass ratio=20 to 60:5 to 30:10 to 50).

For the silicone resin, nitrogen-containing silicone resins, and modified silicone resins produced through reaction of a nitrogen-containing silane coupling agent and silicone resins are exemplified. As the magnetic material for carrier core, it is possible to use ferrite, iron-excessively contained ferrite, magnetite, oxide such as γ-iron oxide; or metal such as iron, cobalt, and nickel or an alloy thereof.

Further, examples of elements contained in these magnetic materials include iron, cobalt, nickel, aluminum, copper, lead, magnesium, tin, zinc, antimony, beryllium, bismuth, calcium, manganese, selenium, titanium, tungsten, and vanadium. Of these elements, copper-zinc-iron-based ferrite containing copper, zinc and iron as main components, and manganese-magnesium-iron-based ferrite containing manganese, magnesium, and iron as main components are particularly preferable.

For the resistance value of the carrier, it is preferable to adjust the degree of irregularities of the carrier surface and the amount of resin used for coating a carrier core so as to be $10^6$ Ω·cm to $10^{10}$ Ω·cm.

The particle diameter of the carrier is preferably 4 μm to 200 μm, more preferably 10 μm to 150 μm, still more preferably 20 μm to 100 μm. In particular, the resin-coated carrier preferably has a $D_{50}$ particle diameter of 20 μm to 70 μm.

In a two-component developer, the toner of the present invention is preferably used in an amount of 1 part by mass to 200 parts by mass, more preferably 2 parts by mass to 50 parts by mass, per 100 parts by mass of the carrier.

<Wax>

The toner of the present invention may further contain a wax together with the binder resin and colorant.

The wax is not particularly limited and may be appropriately selected from commonly used waxes. Examples thereof include aliphatic hydrocarbon waxes (e.g., low-molecular-weight polyethylenes, low-molecular-weight polypropylenes, polyolefin waxes, microcrystalline waxes, paraffin waxes and SAZOLE wax), oxides of aliphatic hydrocarbon waxes (e.g., oxidized polyethylene waxes) and block copolymers thereof, vegetable waxes (e.g., candelilla wax, carnauba wax, Japan wax and jojoba wax), animal waxes (e.g., bees wax, lanolin and spermaceti wax), mineral waxes (e.g., ozokerite, ceresin and petrolatum), waxes containing fatty acid esters as a main component (e.g., montanic acid ester wax and castor wax) and waxes formed by deoxidizing a part or the whole of a fatty acid ester (e.g., deoxidized carnauba wax).

In addition, the following compounds can also be used: saturated straight-chain fatty acids (e.g., palmitic acid, stearic acid, montanic acid, and other straight-chain alkyl carboxylic acid), unsaturated fatty acids (e.g., brassidic acid, eleostearic acid, and parinaric acid), saturated alcohols (e.g., stearyl alcohol, eicosyl alcohol, behenyl alcohol, carnaubyl alcohol, ceryl alcohol, melissyl alcohol, and other long-chain alkyl alcohol), polyols (e.g., sorbitol), fatty acid amides (e.g., linoleic acid amide, olefin acid amide, and lauric acid amide), saturated fatty acid bisamides (e.g., methylenebis capric acid amide, ethylenebis lauric acid amide, and hexamethylenebis capric acid amide), unsaturated fatty acid amides (e.g., ethylenebis oleic acid amide, hexamethylenebis oleic acid amide, N,N'-dioleyl adipic acid amide, and N,N'-dioleyl sebacic acid amide), aromatic biamides (e.g., m-xylenebis stearic acid amide, N,N-distearyl isophthalic acid amide), metal salts of fatty acids (e.g., calcium stearate, calcium laurate, zinc stearate, and magnesium stearate), aliphatic hydrocarbon waxes to which a vinyl monomer such as styrene and acrylic acid is grafted, partial ester compounds between a fatty acid such as behenic acid monoglyceride and a polyol, and methyl ester compounds having a hydroxyl group obtained by hydrogenating plant fats.

In particular, the following compounds are preferably used: a polyolefin obtained by radical polymerizing an olefin under high pressure; a polyolefin obtained by purifying low-molecular-weight by-products of a polymerization reaction of a high-molecular-weight polyolefin; a polyolefin polymerized under low pressure in the presence of a Ziegler catalyst or a metallocene catalyst; a polyolefin polymerized using radiation, electromagnetic wave, or light; a low-molecular-weight polyolefin obtained by thermally decomposing a high-molecular-weight polyolefin; paraffin wax; microcrystalline wax; Fischer-Tropsch wax; synthesized hydrocarbon waxes obtained by synthol method, hydrocoal method, or Arge method; synthesized waxes containing a compound having one carbon atom as a monomer unit; hydrocarbon waxes having a functional group such as hydroxyl group and carboxyl group; mixtures of a hydrocarbon wax and that having a functional group; and these waxes to which a vinyl monomer such as styrene, a maleate, an acrylate, a methacrylate, or a maleic anhydride is grafted.

In addition, these waxes subjected to a press sweating method, a solvent method, a recrystallization method, a vacuum distillation method, a supercritical gas extraction method, or a solution crystallization method, so as to much more narrow the molecular weight distribution thereof are preferably used. Further, low-molecular-weight solid fatty acids, low-molecular-weight solid alcohols, low-molecular-weight solid compounds, and other compounds from which impurities are removed are preferably used.

The wax preferably has a melting point of from 70° C. to 140° C., more preferably from 70° C. to 120° C., so that the resultant toner has a good balance of toner blocking resistance and offset resistance. When the melting point is lower than 70° C., the blocking resistance of toner may degrade. When the melting point is higher than 140° C., the offset resistance may be hardly exhibited.

Further, by using two or more different types of waxes in combination, it is possible to obtain both a plasticizing effect and a releasing effect at the same time.

Waxes having a plasticizing effect may be, for example, those having a low melting point, those having a branched molecular structure, or those having a polar group in their molecular structure.

Waxes having a releasing effect may be, for example, those having a high melting point, those having a linear molecular structure, or those having no functional groups (i.e., non-polar waxes). For example, two or more different waxes in which a difference in melting point is 10° C. to 100° C. may be used in combination. Also, a polyolefin and a graft-modified polyolefin may be used in combination.

When two types of waxes having a similar structure are selected, one wax with a lower melting point exhibits a plasticizing effect, and the other wax with a higher melting point exhibits a releasing effect. Here, when the difference in melting point between these two waxes is 10° C. to 100° C., the plasticizing and releasing effects can be effectively obtained. When the difference in melting point is lower than 10° C., the plasticizing and releasing effects tend to be hardly obtainable in some cases. When the difference in melting point is higher than 100° C., these two waxes do not sufficiently interact with each other, resulting in that the plasticizing and releasing effects may not be obtained to a satisfactory extent. From the viewpoint of obtaining both the plasticizing and releasing effects, at least one wax preferably has a melting point of 70° C. to 120° C., more preferably 70° C. to 100° C.

As described above, the plasticizing effect is exhibited by waxes having a relatively branched molecular structure or having a polar group such as a functional group. The releasing effect is exhibited by waxes having a relatively linear molecular structure or having no functional groups (i.e., non-polar waxes), or by unmodified straight waxes. For example, preferred are a combination of a polyethylene homopolymer or copolymer containing ethylene as the main component and a polyolefin homopolymer or copolymer containing as the main component an olefin other than ethylene, a combination of a polyolefin and a graft-modified polyolefin, a combination of an alcohol wax, fatty acid wax or ester wax and a hydrocarbon wax, a combination of a Fischer-Tropsch wax or polyolefin wax and a paraffin wax or microcrystalline wax, a combination of a Fischer-Tropsch wax and a polyolefin wax, a combination of a paraffin wax and a microcrystalline wax, and a combination of carnauba wax, candelilla wax, rice wax or montan wax and a hydrocarbon wax.

In any case, it is preferred that, among endothermic peaks observed by DSC of a toner, the peak top temperature of the maximum peak exists at 70° C. to 110° C. It is more preferred that the maximum peak exists at 70° C. to 110° C.

The total content of the wax is preferably 0.2 parts by mass to 20 parts by mass, more preferably from 0.5 parts by mass to 10 parts by mass, for every 100 parts by mass of the binder resin.

In the present invention, an endothermic maximum peak temperature of a wax measured by DSC (differential scanning calorimetry) is a melting point of the wax.

As a DSC measurement instrument for use to measure the endothermic maximum peak temperature of the wax or toner, a high-precision inner-heat power-compensation differential scanning calorimeter is preferably used. The measurement is performed according to a method based on ASTM D3418-82. The endothermic curve is obtained by heating a sample at a temperature increasing rate of 10° C./min, after once heating and cooling the sample.

<Flowability Improver>

A flowability improver may be added in the toner of the present invention. The flowability improver is incorporated onto the surface of the toner to improve the flowability thereof.

Examples of the flowability improver include carbon black, fluorine-based resin powders (e.g., fluorinated vinylidene fine powder and polytetrafluoroethylene fine powder), silica fine powders (e.g., wet-process silica and dry-process silica), titanium oxide fine powder, alumina fine powder, and surface-treated silica powders, surface-treated titanium oxide and surface-treated alumina each of which is prepared by subjecting titanium oxide fine powder or alumina fine powder to a surface treatment with a silane coupling agent, titanium coupling agent or silicone oil. Of these, silica fine powder, titanium oxide fine powder, and alumina fine powder are preferable. Further, surface-treated silica powders each of which is prepared by subjecting alumina fine powder to a surface treatment with a silane coupling agent or silicone oil are still more preferably used.

The particle size of the flowability improver is, as an average primary particle diameter, preferably 0.001 μm to 2 μm, more preferably 0.002 μm to 0.2 μm.

The silica fine powder is produced by vapor-phase oxidation of a silicon halide compound, is so-called "dry-process silica" or "fumed silica."

As commercially available products of the silica fine powders produced by vapor-phase oxidation of a silicon halide compound, for example, AEROSIL (trade name, manufactured by Japan AEROSIL Inc.) -130, -300, -380, -TT600, -MOX170, -MOX80 and -COK84; Ca-O-SIL (trade name, manufactured by CABOT Corp.) -M-5, -MS-7, -MS-75, -HS-5, -EH-5; Wacker HDK (trade name, manufactured by WACKER-CHEMIE GMBH) -N20, -V15, -N20E, -T30 and -T40, D-C FINE SILICA (trade name, manufactured by Dow Corning Co., Ltd.), and FRANSOL (trade name, manufactured by Fransil Co.).

Further, a hydrophobized silica fine powder prepared by hydrophobizing a silica fine powder produced by vapor-phase oxidation of a silicon halide compound is more preferable. It is particularly preferable to use a silica fine powder that is hydrophobized so that the hydrophobization degree measured by a methanol titration test is preferably from 30% to 80%. A silica fine powder can be hydrophobized by being chemically or physically treated with an organic silicon compound reactive to or physically adsorbed to the silica fine powder, or the like. There is a preferred method, in which a silica fine powder produced by vapor-phase oxidation of a silicon halide compound is hydrophobized with an organic silicon compound.

Examples of the organic silicon compound include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptane, trimethylsilylmercaptane, triorganosilylacrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinytetramethyldisiloxane, 1,3-diphenyltetramethyldisiloxane, and dimethylpolysiloxane having 2 to 12 siloxane units per molecule and having 0 to 1 hydroxy group bonded to Si in the siloxane units positioned at the terminals. Further, silicone oils such as dimethylsilicone oil are exemplified. These organic silicon compounds may be used alone or in combination.

The number average particle diameter of the flowability improver is preferably 5 nm to 100 nm, more preferably 5 nm to 50 nm.

The specific surface area of fine powder of the flowability improver measured by the BET nitrogen adsorption method is preferably 30 $m^2/g$ or more, more preferably 60 $m^2/g$ to 400 $m^2/g$.

In the case of surface treated fine powder of the flowability improver, the specific surface area is preferably 20 $m^2/g$ or more, and more preferably 40 $m^2/g$ to 300 $m^2/g$.

The amount of the fine powder used is preferably 0.03 parts by mass to 8 parts by mass based on 100 parts by mass of toner particles.

If necessary, other additives may be added to the toner of the present invention for the purposes of, for example, protecting the electrostatic image bearing member/carrier, increasing cleanability and fixability, and adjusting thermal/electrical/physical characteristics, resistance and softening point. Examples of the other additives include various metal soaps, fluorine-containing surfactants, dioctyl phthalate, tin oxide, zinc oxide, carbon black, antimony oxide (serving as a conductivity-imparting agent), and inorganic fine powder (e.g., titanium oxide, aluminum oxide and alumina). The inorganic fine powder may be hydrophobidized, if desired. Further examples include lubricants (e.g., polytetrafluoroethylene, zinc stearate and polyvinylidene fluoride), polishers (e.g., cesium oxide, silicon carbide and strontium titanate) and anti-caking agents. Furthermore, a small amount of white or black fine particles having an opposite polarity to the toner particles may be used as a developability-improving agent.

In order to control the charging amount or other properties, these additives are preferably treated with a treating agent such as silicone varnish, various modified silicone varnishes, silicone oil, various modified silicone oils, a silane coupling agent, a functional group-containing silane coupling agent, or organic silicon compounds.

In the preparation of a developer, inorganic fine particles (e.g., hydrophilic silica fine powder) may be added/mixed for improving the developer in flowability, storageability, developability and transferability. A commonly-used powder mixing machine may be appropriately used for mixing the external additive. Preferably used is a powder mixing machine whose internal temperature can be adjusted using a jacket or the like. The additive should be added at an intermediate point, or progressively, in order to change the rate of adherence (adhesion strength) of the external additive to the surface of the toner base particles. Of course, it is also possible to vary the speed of rotation, the processing time, the temperature, and the like, of the mixing machine. For example, it is possible to apply a strong load at first and then apply a relatively weak load, or vice versa.

Examples of the mixing machine employable include V type mixers, rocking mixers, Loedige mixer, Nauta mixer, and Henschel mixer.

Inorganic fine particles are preferably used as the external additive.

Examples of the inorganic particles include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide and silicon nitride.

The inorganic fine particles preferably have a primary particle diameter of 5 nm to 2 μm, more preferably 5 nm to 500 nm.

Also, the inorganic fine particles preferably have a specific surface area of 20 $m^2/g$ to 500 $m^2/g$, as measured by the BET method.

The amount of the inorganic fine particles used is preferably 0.01% by mass to 5% by mass, more preferably 0.01% by mass to 2.0% by mass to the toner.

Further examples of the external additive include polymer fine particles such as polystyrenes, methacrylic acid esters and acrylic acid ester copolymers (which are obtained through soap-free emulsification polymerization, suspension polymerization, or dispersion polymerization) and polymer particles obtained from a polycondensate resin and a thermosetting resin (e.g., silicone, benzoguanamine and nylon).

Such external additives may be treated with a surface-treating agent to increase their hydrophobicity, and may be prevented from degradation even under high-humidity conditions.

Preferred examples of the surface-treating agent include silane coupling agents, silylating agents, fluorinated alkyl group-containing silane coupling agents, organic titanate-based coupling agents, aluminum-based coupling agents, silicone oil and modified silicone oil.

The inorganic fine particles preferably have a primary particle diameter of 5 nm to 2 μm, more preferably 5 nm to 500 nm. Also, the inorganic fine particles preferably have a specific surface area of 20 $m^2/g$ to 500 $m^2/g$, as measured by the BET method. The amount of the inorganic fine particles used is preferably 0.01% by mass to 5% by mass, more preferably 0.01% by mass to 2.0% by mass to the toner.

A cleanability improver may be added to the toner. The cleanability improver is for removing the developer remaining after transfer on the electrostatic image bearing member and/or primary transfer medium. Examples thereof include fatty acid metal salts (e.g., zinc stearate, calcium stearate and stearic acid) and polymer fine particles produced through soap-free emulsification polymerization (e.g., polymethyl methacrylate fine particles and polystyrene fine particles). Preferably, the polymer particles have a relatively narrow particle size distribution and a volume average particle diameter of 0.01 μm to 1 μm.

A developing method using the toner of the present invention is applicable to all electrostatic image bearing members used in conventional electrophotographic methods. The developing method is suitably applicable to, for example, organic electrostatic image bearing members, amorphous silica electrostatic image bearing members, selenium electrostatic image bearing members and zinc oxide electrostatic image bearing members.

EXAMPLES

The present invention will next be described in detail by way of examples, which should not be construed as limiting the present invention thereto.

—Preparation of Colorant Dispersion Liquid—

First, a dispersion liquid of carbon black (colorant) was prepared.

Carbon black (Regal 400, product of Cabot) (17 parts by mass) and a pigment dispersing agent (3 parts by mass) were primarily dispersed in ethyl acetate (80 parts by mass) using a mixer having an impellor. The pigment dispersing agent used was AJISPER PB821 (product of Ajinomoto Fine Techno Co., Ltd.). The obtained primarily dispersed liquid was finely dispersed by the action of strong shearing force using a DYNO-MILL. Subsequently, aggregates having a particle diameter of 5 μm or greater were completely removed from the resultant dispersion liquid, to thereby prepare a secondarily dispersed liquid (i.e., a colorant-dispersed liquid).

—Preparation Of Wax Dispersion Liquid—

Next, a wax dispersion liquid was prepared.

Carnauba wax (18 parts by mass) and a wax dispersing agent (2 parts by mass) were primarily dispersed in ethyl acetate (80 parts by mass) using a mixer having an impellor. While being stirred, the obtained primarily dispersion liquid was heated to 80° C. to dissolve carnauba wax. Then, the liquid temperature of the resultant liquid was decreased to room temperature to precipitate wax particles having a particle diameter of up to 3 μm. The wax dispersing agent used was formed by grafting a styrene-butyl acrylate copolymer to polyethylene wax. Further, the obtained dispersion liquid was finely dispersed by the action of strong shearing force using a DYNO-MILL so that the maximum diameter of the wax particles was adjusted up to 2 μm.

—Preparation of Toner Composition Dispersion Liquid—

Next, a resin (serving as a binder resin), the above-prepared colorant dispersion liquid and the above-prepared wax dispersion liquid were used in the following proportion to prepare a toner composition dispersion liquid.

Specifically, a polyester resin (binder resin) (100 parts by mass), the colorant dispersion liquid (30 parts by mass), the wax dispersion liquid (30 parts by mass) and ethyl acetate (840 parts by mass) were stirred for 10 min using a mixer having an impellor, whereby a homogeneously dispersed liquid was prepared.

No aggregates were formed from the pigments or wax particles due to a shock of solvent dilution. Notably, this dispersion liquid was found to have an electrical conductivity of $1.8\times10^{-7}$ S/m.

Example 1 and Comparative Example 1

Fabrication of Liquid-Discharging Head

A liquid-discharging head of Example 1 was fabricated as follows. Specifically, a PZT plate (dimension: 5 mm×2 mm×1 mm) was provided with grooves at intervals of 200 μm to form a plurality of elongated convex portions, whereby a vibration generating unit was formed. The thus-formed vibration generating unit was bonded to a vibrating plate so that portions of a nozzle plate where nozzles were formed faced every other elongated convex portion (see FIG. 2), whereby a liquid-discharging head was fabricated. Divided liquid chambers were fabricated following the process as illustrated in FIGS. 8A to 8D. Specifically, an SOI substrate (thickness: 500 μm) was provided with the liquid chambers so that the width of openings 115 was 100 μm, the diameter of nozzle openings 116 was 8.5 μm, and the distance between the openings arranged in a lattice form was 100 μm. The nozzle plate was positioned so that 20 nozzles were placed in each liquid chamber. The number of nozzles was set to 200 in total in the liquid-discharging head. The vibrating plate used was a nickel plate (bonded portion: 7 μm to 10 μm, unbonded portion: 5 μm or smaller).

Figure 9:
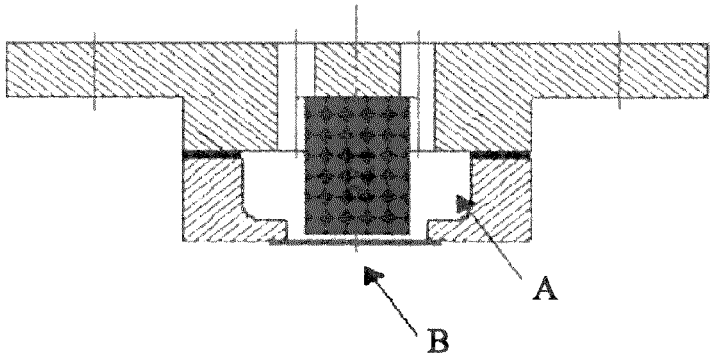
FIG. 9 is a cross-sectional view of a liquid-discharging head used in Comparative Example 1.
Figure 10:
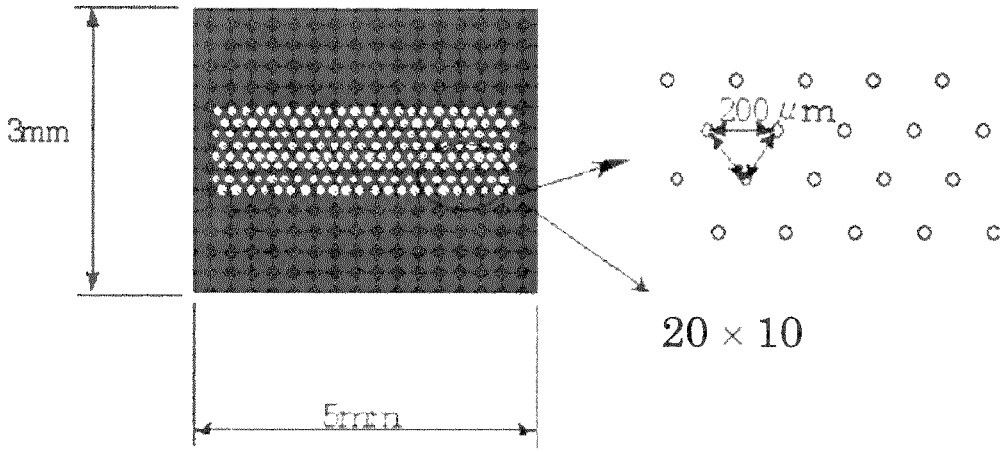
FIG. 10 illustrates nozzles of a nozzle plate used in Comparative Example 1.

Also, a liquid-discharging head of Comparative Example 1 was fabricated using a PZT plate with no grooves. As illustrated in FIG. 9, this liquid-discharging head contains a PZT plate (dimension: 4 mm×1.6 mm×1 mm) placed in one liquid chamber denoted by symbol A. As illustrated in FIG. 10, a nozzle plate (denoted by symbol B in FIG. 9) of the liquid chamber was provided with 200 (20×10) nozzles (the same number as in Example 1) arranged in a lattice form at intervals of 200 μm.

—Production of Toner—

The above-fabricated liquid-discharging head having the grooved PZT plate or the non-grooved PZT plate was mounted into a liquid droplet jetting unit 2 as illustrated in FIG. 1. By feeding the toner composition dispersion liquid to the apparatus, toner was produced.

The production conditions were as follows.

<Configuration of Storage Part and Drive Frequency>

Frequency of excited vibration (vibration frequency): 32.7 kHz

Number of nozzles per head: 200

Flow rate of gas flow supplied through gas flow path: 20 m/s (as an average linear velocity in the vicinity of nozzles)

After the preparation of the dispersion liquid, liquid droplets were discharged with dry nitrogen gas flowing in the apparatus at 30.0 L/min, followed by drying for solidification, to thereby produce toner base particles.

The Dv/Dn of the toner base particles and the continuous jetting time were shown in Table 1. The Dv/Dn was obtained by measuring the liquid droplets with LaVision.

TABLE 1

| | Dv/Dn | Continuous Jetting Time |
|---|---|---|
| Example 1 | 1.02 | 20 min or longer |
| Comparative Example 1 | 1.28 | Down at 35 sec |

As shown in Table 1, in Example 1, relatively controlled vibration was generated and uniform liquid droplets were obtained. In contrast, in Comparative Example 1, the liquid droplets had large variation and non-discharged areas were observed. In addition, air bubbles caused the apparatus to be down at about 30 sec.

After collected through cyclone, the dried/solidified toner base particles obtained in Example 1 were treated with 1.0% by mass of a hydrophobic silica (external additive) (H2000, product of Clariant Japan K. K.) using a HENSCHEL mixer (product of MITSUI MINING COMPANY, LIMITED.), whereby a black toner was obtained. As a result of the measurement for the particle size distribution using a flow particle image analyzer (FPIA-2000) under the following measurement conditions, the collected toner base particles were found to have a weight average particle diameter (D4) of 5.3 μm and a number average particle diameter (Dn) of 5.1 μm. Furthermore, the amount of toner base particles produced in 1-hour operation was 9.8 g.

—Evaluation of Toner—

The obtained toner was evaluated as follows. Notably, the evaluation results are shown in Table 2.

<Particle Size Distribution>

The measurement method using the flow particle image analyzer will be described below.

For measurement of a toner (toner particles) and an external additive with a flow particle image analyzer, it is possible to use, for example, flow particle image analyzer FPIA-2000 (product of Toa Medical Electronics Co., LTD).

Specifically, water was caused to pass through a filter to remove fine dust so as to contain 20 or smaller particles per $10^{-3}$ $cm^3$, which have a particle size falling within a measurement range (e.g., a circle-equivalent diameter of 0.60 μm or greater and smaller than 159.21 μm). Then, several drops of a nonionic surfactant (preferably, Contaminon N (product of Wako Pure Chemical Industries, Ltd.)) were added to 10 mL of the above-prepared water. In addition, a measurement sample (5 mg) was added to the resultant liquid, followed by dispersing for 1 min with a ultrasonic disperser UH-50 (product of STM Corporation) at 20 kHz and 50 W/10 $cm^3$. Furthermore, the resultant dispersion liquid was dispersed for 5 min so as to prepare a sample dispersion liquid containing 4,000 to 8,000 particles per $10^{-3}$ $cm^3$, which have a circle-equivalent diameter falling within a measurement range. The thus-prepared sample dispersion liquid was measured for particle distribution of particles having a circle-equivalent diameter of 0.60 μm or greater and smaller than 159.21 μm.

The sample dispersion liquid is caused to pass through the flow channel (extending in a flow direction) of a flat transparent flow cell (thickness: about 200 μm). In order to form an optical path which passes through and intersects with the flow cell in the thickness direction, a stroboscope and a CCD camera are mounted on the flow cell so as to be located at the opposite side to each other. With the sample dispersion liquid flowing, strobe light is applied thereto at an interval of 1/30 sec so as to obtain an image of a particle(s) flowing in the flow cell. As a result, each particle is photographed as a two-dimensional image having a certain area parallel to the flow cell. Based on the area of each particle in the two-dimensional image, the diameter of a circle having the same area is calculated as a circle-equivalent diameter.

The circle-equivalent diameter of 1,200 or more particles can be measured for about 1 min. The number of the particles can be measured based on the measured circle-equivalent diameter. Similarly, the rate (number %) of particles with a predetermined circle-equivalent diameter can be measured. As shown in Table 2, the results (frequency % and cumulative %) can be obtained by dividing a range of 0.06 μm to 400 μm into 226 channels (dividing 1 octave into 30 channels). The actual measurement is performed on particles having a circle-equivalent diameter of 0.60 μm or greater and smaller than 159.21 μm.

<Reproducibility of Thin Line>

A developer was charged into a modified machine fabricated by modifying the developing device of a commercially available copier (IMAGIO NEO 271, product of Ricoh Company, Ltd.). Subsequently, running was performed using the above copier and 6000 paper (product of Ricoh Company, Ltd.) at an image occupation rate of 7%. Then, the tenth image and the thirty thousandth image were compared in thin line portions with the original image. Specifically, these images were observed under an optical microscope at ×100, and evaluated on a one-to-four scale through comparison with a standard sample in terms of defects of a line. An image quality is higher as follows: A>B>C>D. In particular, the image evaluated as "D" is not a practically acceptable level. An organic electrostatic latent image bearing member was used for a negatively-charged toner, and an amorphous silicon electrostatic latent image bearing member was used for a positively-charged toner.

Upon development, a resin-coated carrier that had been used in a conventional electrophotography was used to transfer the toner particles. The following carrier was used.

[Carrier]

Core material: spherical ferrite particles with an average particle diameter of 50 μm Coating material component: silicone resin The silicone resin was dispersed in toluene to prepare a dispersion liquid. The core material was spray-coated with the dispersion liquid under heating conditions, followed by firing and cooling, to thereby produce carrier particles coated with a resin film having an average thickness of 0.2 μm.

Example 2

The procedure of Example 1 was repeated, except that 24 nozzles were arranged at intervals of 80 μm in one liquid chamber, that the number of liquid chambers was set to 200, and that the number of nozzles per head was set to 4,800, to thereby produce an intended toner.

<Configuration of Storage Part and Drive Frequency>

Frequency of excited vibration: 32.7 kHz

Number of nozzles per head: 4,800

Flow rate of gas flow supplied through gas flow path: 20 m/s (as an average linear velocity in the vicinity of nozzles)

The dried/solidified toner particles were collected through cyclone. As a result of the measurement for the particle size distribution using a flow particle image analyzer (FPIA-2000) in the above-described manner, the collected toner particles were found to have a weight average particle diameter (D4) of 5.4 μm and a number average particle diameter (Dn) of 5.2 μm. Furthermore, the amount of toner produced in 1-hour operation was 320 g.

Example 3

The procedure of Example 2 was repeated, except that the nozzles were arranged at intervals of 60 μm and the number of nozzles per head was set to 7,200, to thereby produce an intended toner.

<Configuration of Storage Part and Drive Frequency>

Frequency of excited vibration: 32.7 kHz

Number of nozzles per head: 7,200

Flow rate of gas flow supplied through gas flow path: 20 m/s (as an average linear velocity in the vicinity of nozzles)

The dried/solidified toner particles were collected through cyclone. As a result of the measurement for the particle size distribution using a flow particle image analyzer (FPIA-2000) in the above-described manner, the collected toner particles were found to have a weight average particle diameter (D4) of 5.4 μm and a number average particle diameter (Dn) of 5.2 μm. Furthermore, the amount of toner produced in 1-hour operation was 382 g.

Example 4

The procedure of Example 3 was repeated, except that the frequency of excited vibration was set to 40.2 kHz, to thereby produce an intended toner.

<Configuration of Storage Part and Drive Frequency>

Frequency of excited vibration: 40.2 kHz

Number of nozzles per head: 7,200

Flow rate of gas flow supplied through gas flow path: 20 m/s (as an average linear velocity in the vicinity of nozzles)

The dried/solidified toner particles were collected through cyclone. As a result of the measurement for the particle size distribution using a flow particle image analyzer (FPIA-2000) in the above-described manner, the collected toner particles were found to have a weight average particle diameter (D4) of 5.2 μm and a number average particle diameter (Dn) of 5.0 μm. Furthermore, the amount of toner produced in 1-hour operation was 465 g.

Example 5

The procedure of Example 3 was repeated, except that the frequency of excited vibration was set to 57.3 kHz, to thereby produce an intended toner.

<Configuration of Storage Part and Drive Frequency>

Frequency of excited vibration: 57.3 kHz

Number of nozzles per head: 7,200

Flow rate of gas flow supplied through gas flow path: 20 m/s (as an average linear velocity in the vicinity of nozzles)

The dried/solidified toner particles were collected through cyclone. As a result of the measurement for the particle size distribution using a flow particle image analyzer (FPIA-2000) in the above-described manner, the collected toner particles were found to have a weight average particle diameter (D4) of 5.1 μm and a number average particle diameter (Dn) of 4.8 μm. Furthermore, the amount of toner produced in 1-hour operation was 668 g.

TABLE 2

| | Weight average particle diameter [μm] | Number average particle diameter [μm] | Productivity per unit time [g/hr] | Reproducibility of thin line |
|---|---|---|---|---|
| Ex. 1 | 5.3 | 5.1 | 9.8 | A |
| Ex. 2 | 5.4 | 5.2 | 320 | A |
| Ex. 3 | 5.4 | 5.2 | 382 | A |
| Ex. 4 | 5.2 | 5.0 | 465 | A |
| Ex. 5 | 5.1 | 4.8 | 668 | B |

As is clear from Table 2, toner production can be efficiently performed by the present invention. In addition, the produced toner was found to have remarkably excellent properties.

Furthermore, the images formed through development with the toner produced in accordance with the present invention were found to reproduce the corresponding latent electrostatic image with fidelity and have a remarkably high image quality.

As described above, the toner production method of the present invention can efficiently produce toner having such a monodispersibility that could not be attained in conventional toner. Thus, the produced toner can be used to prepare a developer used for developing electrostatic images in, for example, electrophotography, electrostatic recording and electrostatic printing. This developer has almost no or still less variation than those produced with a conventional production method in terms of various characteristics required for toner such as flowability and charging characteristics.

What is claimed is:

1. A toner-producing apparatus, comprising a liquid-discharging head and a particle forming unit configured to solidify liquid droplets, thereby forming particles, wherein the liquid-discharging head comprises:

a reservoir suitable for a spray liquid, a nozzle plate comprising a plurality of nozzles suitable for discharging the spray liquid reserved in the reservoir, and a vibration generating unit comprising a vibrating surface facing the nozzle plate, wherein the reservoir is divided into a plurality of liquid chambers, wherein the vibration generating unit comprises elongated convex portions in a plurality of rows, the elongated convex portions comprising a piezoelectric element, wherein each of the liquid chambers corresponds to one of the elongated convex portions, wherein the apparatus is configured to produce particles by periodically discharging liquid droplets of the spray liquid from the nozzles and solidifying the liquid droplets, thereby forming particles with a ratio Dv/Dn of a volume average particle diameter Dv to a number average particle diameter Dn of less than 1.28, and wherein a number of nozzles facing one liquid chamber is from 2 to 200.

2. The toner-producing apparatus according to claim 1, wherein the elongated convex portions are obtained by a process comprising forming grooves in one plate-like piezoelectric element in a plurality of rows.

3. The toner-producing apparatus according to claim 1, wherein the spray liquid is a toner composition liquid prepared by a process comprising dispersing or dissolving a toner composition comprising a resin and a colorant.

4. The toner-producing apparatus according to claim 1, wherein the nozzles are at intervals of 60 μm to 200 μm.

5. The toner-producing apparatus according to claim 1, wherein a surface of the nozzle plate comprises fine concave and convex portions with a peak-to-valley height of 0.2 μm or smaller at high density.

6. The toner-producing apparatus according to claim 1, wherein the liquid discharging head further comprises a fluorine-containing coating material coating a surface of the nozzle plate.

7. The toner-producing apparatus according to claim 1, wherein the plurality of nozzles comprises nozzles with different diameters corresponding to one liquid chamber.

8. The toner-producing apparatus according to claim 1, wherein the nozzle plate comprises a nozzle from which the spray liquid is not discharged.

9. The toner-producing apparatus according to claim 7, wherein a product of liquid pressure on each nozzle and area of an opening of each nozzle is constant.

10. The toner-producing apparatus according to claim 8, wherein an area of an opening of a nozzle from which the spray liquid is not discharged is twice or more greater than an area of an opening of a nozzle from which the spray liquid is discharged.

11. A toner, comprising:

particles with a ratio Dv/Dn of a volume average particle diameter Dv to a number average particle diameter Dn of less than 1.28, obtained by a process comprising dispersing or dissolving a toner composition comprising a resin and a colorant, thereby forming a spray liquid, periodically discharging liquid droplets of the spray liquid from a plurality of nozzles, and solidifying the liquid droplets, wherein the toner is produced with a toner-producing apparatus, the toner apparatus comprising a particle forming unit and a liquid discharging head, wherein the liquid discharging head comprises a reservoir suitable for the spray liquid, a nozzle plate comprising the plurality of nozzles, and a vibration generating unit comprising a vibrating surface facing the nozzle plate, wherein the reservoir is divided into a plurality of liquid chambers, wherein the vibration generating unit comprises elongated convex portions in a plurality of rows, wherein each of the liquid chambers corresponds to one of the elongated convex portions, and wherein a number of nozzles facing one liquid chamber is from 2 to 200.

12. A method of producing particles, the method comprising:

periodically discharging liquid droplets of a spray liquid from a plurality of nozzles with a liquid-discharging head, and solidifying the liquid droplets, thereby forming particles with a ratio Dv/Dn of a volume average particle diameter Dv to a number average particle diameter Dn of less than 1.28, wherein the liquid-discharging head comprises a reservoir suitable for the spray liquid, a nozzle plate comprising the plurality of nozzles suitable for discharging the spray liquid reserved in the reservoir, and a vibration generating unit comprising a vibrating surface facing the nozzle plate, wherein the reservoir is divided into a plurality of liquid chambers, wherein the vibration generating unit comprises elongated convex portions in a plurality of rows, wherein the elongated convex portions comprise a piezoelectric element, wherein each of the liquid chambers corresponds to one of the elongated convex portions, and wherein a number of nozzles facing one liquid chamber is from 2 to 200.

13. The method according to claim 12, wherein the elongated convex portions are made by a process comprising forming grooves in one plate-like piezoelectric element in a plurality of rows.

14. The method according to claim 12, wherein the spray liquid is a toner composition liquid prepared by a process comprising dispersing or dissolving a toner composition comprising a resin and a colorant.

15. The method according to claim 12, wherein the vibration frequency of the vibration generating unit is 10 kHz or higher but lower than 2.0 MHz.

16. The method of claim 12, further comprising:

generating a vibration in the vibrating surface by the vibrating unit, and transmitting the vibration to the spray liquid in the reservoir, thereby obtaining a liquid resonance.

17. The method of claim 12, further comprising supplying the spray liquid in a circulating system.

* * * * *